US005277251A

United States Patent [19]

Blount et al.

[11] Patent Number: 5,277,251

[45] Date of Patent: Jan. 11, 1994

[54] METHOD FOR FORMING A WINDOW IN A SUBSURFACE WELL CONDUIT

[76] Inventors: Curtis G. Blount, 251 Gail Dr., Wasilla, Ak. 99654; Charles M. Hightower, 641 Post Oak Dr., Plano, Tex. 75025; Charles D. Hailey, 1661 Exchange Ave., Oklahoma City, Okla. 73108

[21] Appl. No.: 958,639

[22] Filed: Oct. 9, 1992

[51] Int. Cl.[5] ..... E21B 33/00

[52] U.S. Cl. ..... 166/117.5

[58] Field of Search ..... 166/117.5, 297, 298, 166/55, 380; 175/61

[56] References Cited

U.S. PATENT DOCUMENTS

| | | | |
|---|---|---|---|
| 5,115,872 | 5/1992 | Brunet et al. | 166/117.5 X |
| 5,195,591 | 3/1993 | Blount et al. | 166/117.5 X |
| 5,211,715 | 5/1993 | Braden et al. | 166/117.5 X |

*Primary Examiner*—Thuy M. Bui

*Attorney, Agent, or Firm*—Roderick W. MacDonald

[57] ABSTRACT

A method for forming a window in a subsurface well conduit using a coiled tubing unit together with standard rotary rig tools adopted for use with a coiled tubing unit, and a whipstock with no wear projection on the guide surface thereof, and controlling the angular relationship between the tools and the whipstock while forming the window.

10 Claims, 4 Drawing Sheets

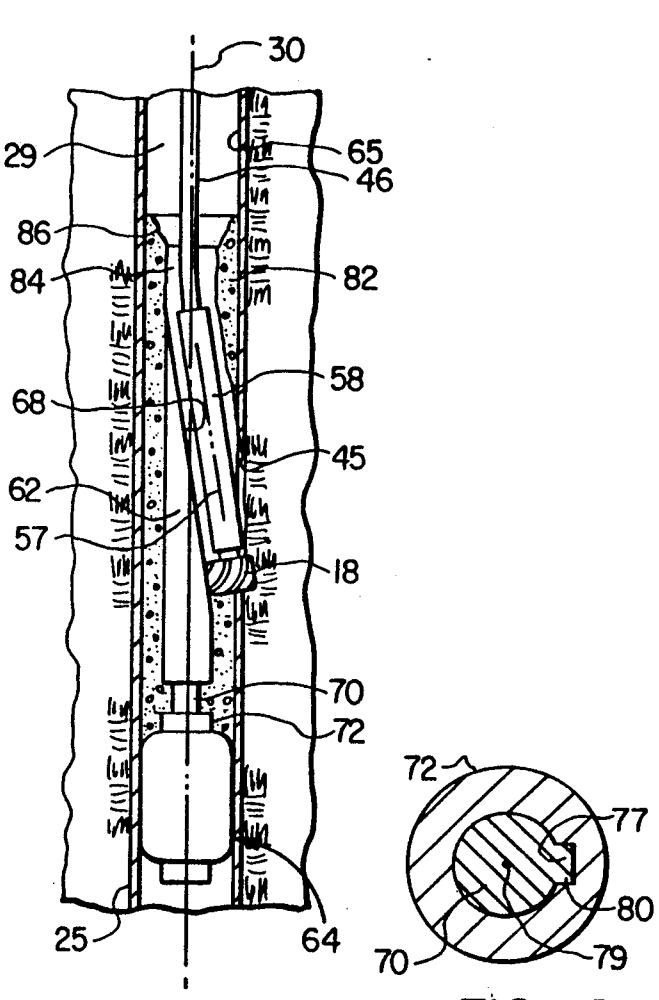
FIG. 7
FIG. 8
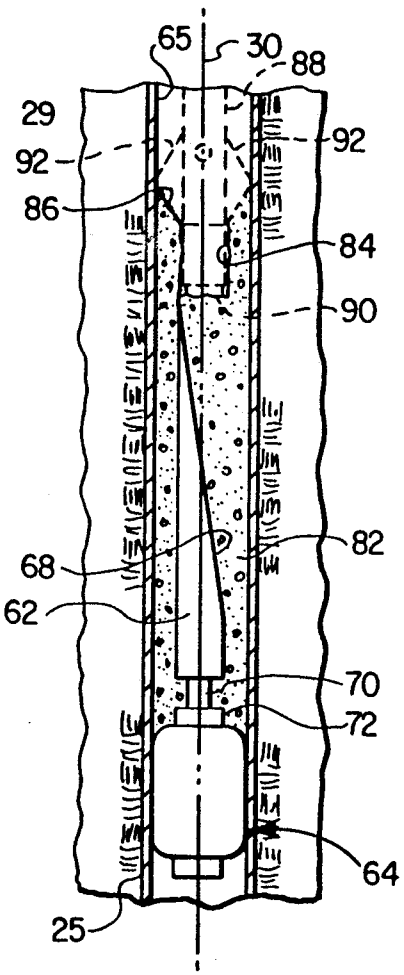
FIG. 6
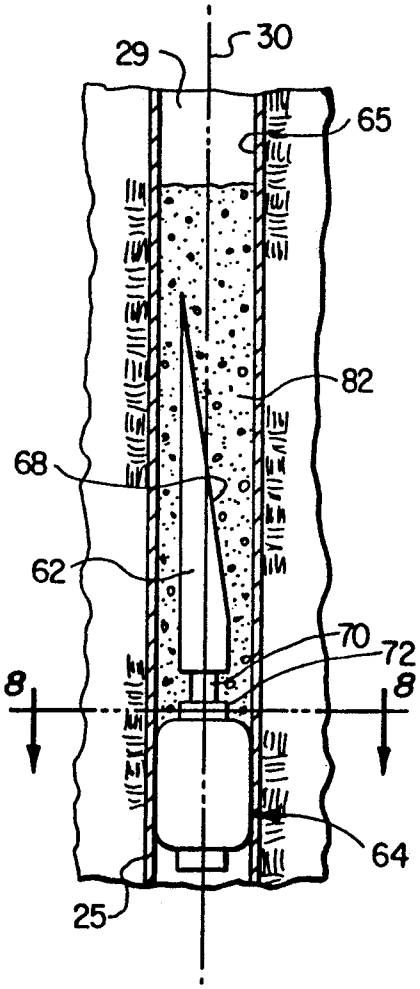
FIG. 5

METHOD FOR FORMING A WINDOW IN A SUBSURFACE WELL CONDUIT

BACKGROUND OF THE INVENTION

In subterranean well operations, it is necessary from time to time to remove a section of subsurface well conduit such as a tubing string or a well casing. Accordingly, several types of tubing and/or casing cutting and milling tools and procedures have been developed for use with conventional rotary drilling rigs. The cost and time consumed in using a conventional rotary drilling rig is considerable and there has been a trend towards the use of coiled tubing units for various well operations heretofore conducted with conventional drilling rigs.

Coiled tubing units are known in the art, but not widely used in the field yet. Coiled tubing units are nevertheless available on a commercial basis. Inventions such as that disclosed herein will render coiled tubing units more readily useful in the field by reducing both the cost and time expenditure, as compared to a conventional drilling rig, for a given operation.

Heretofore, tools and procedures have been developed for use with conventional drilling rigs for removing a section of a well conduit, whether it is tubing or casing, but these tools and procedures cannot be transferred unchanged to a coiled tubing unit and employed successfully in the same manner as employed in the conventional drilling rig. The use of conventional drilling rig tools and procedures in a coiled tubing context has several shortcomings. For example, control over the axial downward pressure on the tool or tools employed downhole is difficult to maintain because of the flexibility of the coiled tubing string. Accordingly, the cutting or milling tool may wear prematurely or unduly cut into other downhole tools such as whipstocks. The tools may also deflect the tubing being cut resulting in failure of the tools themselves and/or jamming of the tools in the tubing thereby causing an expensive fishing job or even abandonment of the well.

Further, conventional drilling rig cutting and milling tools are not adapted to be inserted into a casing string through a smaller diameter tubing string contained in that casing string. These types of tools require removal of the tubing string in its entirety from the casing and wellbore before the cutting and milling tools can be inserted into the casing and operated to form a window in that casing.

Also, conventional drilling rig cutting and milling tools are difficult to operate on a tubing string since, in many instances, the tubing string may be forced off center with respect to the longitudinal axis of the larger diameter casing string in which the tubing string to be cut and milled is located.

Finally, conventional rotary drilling rigs often put a very large amount of weight on the conduit cutting and milling tools in order to make up for the relatively slow rotational speed for a rotary rig, but this weight has a disadvantage of sometimes rotating and therefore disorienting the whipstock with the result that the window is not formed at the desired location in the well conduit. With a coiled tubing unit, the cutting and milling tools can be routinely rotated at much higher speeds than with a conventional rotary rig thereby eliminating the need for putting large amounts of weight on those tools in operation as is normally done with a conventional rotary rig.

SUMMARY OF THE INVENTION

Accordingly, this invention provides a method for forming a window in a subsurface well conduit using a coiled tubing unit together with standard rotary rig tools for forming such a window, such tools being adapted to be readily used in a coiled tubing unit.

By this invention, high speed, low tool weight window formation is possible with all the economies of cost and time that come with a coiled tubing unit together with the efficiency gained by using known downhole tools in such a manner that these tools do not cause problems as set forth hereinabove when used in a coiled tubing operation.

In accordance with the method of this invention the desired window is formed by using a commercially available downhole motor in combination with a conventional milling tool which downhole motor-mill combination is employed at one end of a coiled tubing string. A downhole whipstock of any desired design, be it conventional or non-conventional, is employed to direct the mill against the conduit where the window is to be formed. However, unlike the prior art, this invention does not employ any wear projection for guiding the mill against the conduit wall and does not use a conventional rotary rig "starting" mill tool.

This invention is adapted to use a conventional "window" mill which, as will be shown hereinafter, is quite different in structure from a starting mill. This invention uses the window mill as the initial and primary mill for forming the window whereas the prior art uses a starting mill as the initial and primary mill for forming a window. The relationship of the downhole motor-mill combination to the guide surface of the whipstock is adjusted by this invention so that even with the unconventional use of a window mill, the conduit is preferentially cut by the mill with little or no wear on the whipstock itself. The use with coiled tubing of (1) a whipstock without a wear projection and (2) a window mill in lieu of the conventional starting mill would, without the teaching of this invention, lead to severe cutting of the whipstock by the window mill even in preference to cutting of the well conduit. This situation severely damages the whipstock, severely increases the time and cost of the window formation operation and can even result in a poorly cut window which can catch and hang up other tools which are subsequently run through the window while carrying out other well operations. This disadvantage is avoided by this invention in the control of the angular relationship between the downhole motor-mill combination in relation to the whipstock and well conduit.

Accordingly, it is an object of this invention to provide a new and improved method for forming a window in subsurface well conduits.

It is another object to provide a new and improved method for employing coiled tubing technology together with conventional downhole tools in a unique manner such that all the advantages of a coiled tubing unit can be achieved without the requirement for unique downhole tools but without the disadvantages normally encountered when conventional tools are employed without modification on coiled tubing.

It is another object to provide a new and improved method for forming a window with a conventional whipstock in a subsurface well conduit at significantly reduced cost and time expenditure over conventional rotary rig procedures without substantial damage to the whipstock employed in the window formation operation.

Other aspects, objects and advantages of this invention will be apparent to those skilled in the art from this disclosure and the appended claims.

DESCRIPTION OF THE DRAWINGS

FIGS. 5 through 7 show in greater detail the window formation procedure of this invention.

FIG. 8 shows a cross section of the portion of the apparatus shown in FIGS. 5 through 7 for orienting the whipstock.

DETAILED DESCRIPTION

Figure 1:
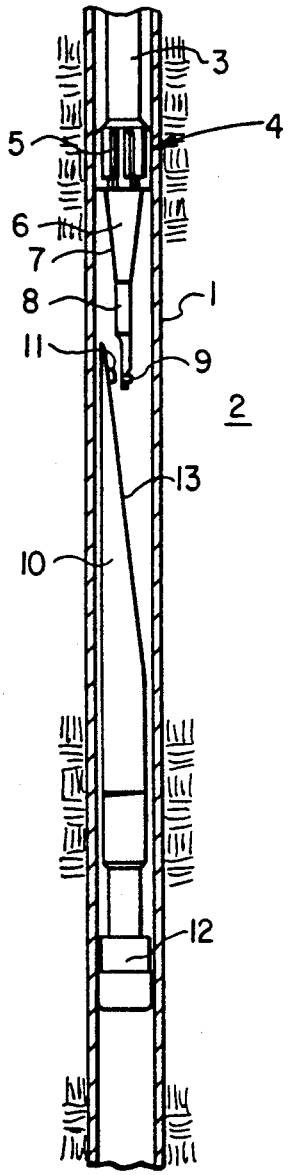
FIG. 1 (PRIOR ART)
FIGS. 1, 2, and 3 show a conventional rotary rig prior art process for forming a window in a subsurface well conduit.

Referring to FIG. 1, there is shown a conventional subsurface well conduit 1 which in the case of FIG. 1 is casing 1. Casing 1 lines a wellbore that has been drilled into earth 2 a finite distance. At the earth's surface (not shown) a conventional rotary drilling rig (not shown) employs a conventional jointed pipe (non-coiled) string 3 which is composed of a plurality of straight sections of pipe joined to one another by conventional coupling means at the bottom of which is carried a conventional starting mill 4. Starting mill 4 is composed of a cutting head 5 that is designed to cut through casing 1. Below head 5 extends a frusto-conical member 6 having a sloping wear surface 7. Member 6 carries at its lower end a sub 8 which is adapted at its lower end to carry shear pin 9. Shear pin 9 is connected to conventional whipstock 10 through wear projection 11. Wear projection 11 is often referred to in the art as a wear pad or wear lug and remains as a fixed projection on guide surface 13 after pin 9 is sheared and sub 8 separated from whipstock 10. Whipstock 10 is connected to and rests upon a conventional pack-off 12.

Whipstocks normally have a guide surface 13 which cuts across the long axis of the wellbore and well conduits therein such as casing 1. Wear surface 7 bears on projection 11 to direct millhead 5 against casing 1 after shear pin 9 is sheared. Thus, in operation, the assembly of tools from reference numeral 5 through reference numeral 10 are set down on packer 12 in one trip into the wellbore or hole and after whipstock 10 is suitably engaged with packer 12, shear pin 9 is sheared by additional downward workstring weight thereon transmitted through tubing 3 from the drilling rig at the surface of the earth. Wear projection 11 being formed on guide surface 13 so that it remains after shear pin 9 is sheared, further movement downward of starting mill 4 caused by the lowering of tubing 3 and engagement of sloped surface 7 with wear projection 11 forces millhead 4 away from guide surface 13 against casing 1 to form the desired window 15 (FIG. 2) in casing 1.

Figure 2:
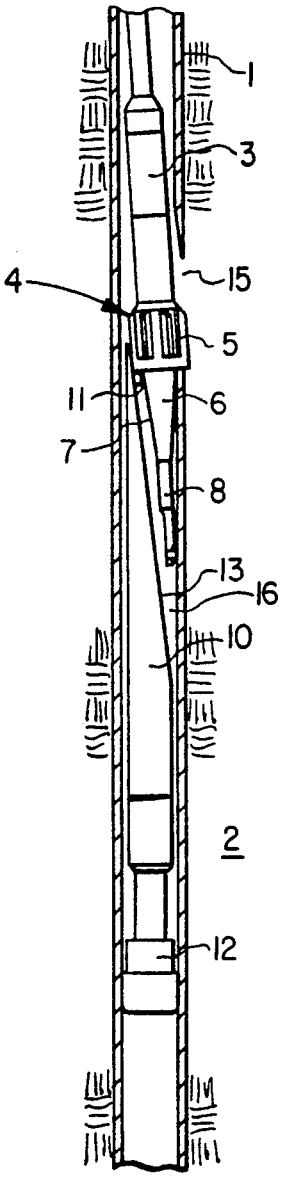
FIG. 2 (PRIOR ART)

The result of such operation is shown in FIG. 2 which shows millhead 5 to have cut window 15 in casing 1. Note in FIG. 2 that the length of window 15 formed along the longitudinal length of casing 1 is limited substantially by members 6 and 8 which eventually jam between guide surface 13 and casing 1 when members 6 and 8 approach the lower end of interior space 16 that exists between the inner wall of casing 1 and guide surface 13. Such a disadvantage is avoided by the method of this invention.

Figure 3:
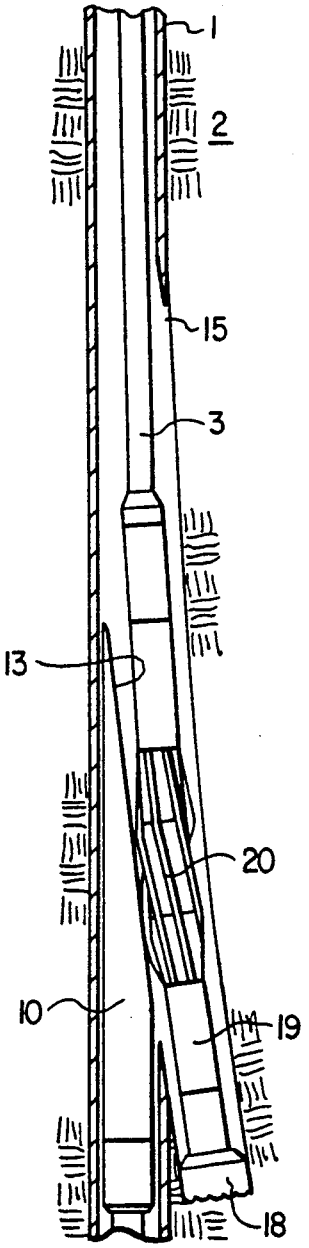
FIG. 3 (PRIOR ART)

FIG. 3 shows the next prior art step, after initial window formation with starting mill 4 of FIGS. 1 and 2, involves enlarging window 15 by use of a window mill 18 can be a diamond speed mill, crushed carbide mill or the like and which is conventionally employed after a starting mill has formed an opening in the casing wall so that the desired window can be formed by the window mill. Window mill 18 does not employ guide member 6 or rely on a wear projection 11. Window mill 18 which is connected by way of sub 19 to a watermelon shaped mill 20 all of which are carried at the bottom of tubing string 3 and operated from the earth's surface by way of the rotary table (not shown) on a conventional drilling rig at the earth's surface.

The method described for FIGS. 1 through 3 requires three trips into and out of the wellbore, the first trip to set whipstock 10 onto packer 12, the second trip to use starting mill 4 in the manner shown in FIG. 2, and the third trip to enlarge and dress the window by use of window mill 18 and watermelon mill 20 as shown in FIG. 3. However, large amounts of weight put on mills 4, or 18 and 20 the rotary rig substantially increases the risk of disorienting whipstock 10 and forming window 15 in a position other than desired. If window 15 is not formed in the desired location, the procedure has to be repeated if possible or else the proposed well lost.

By the practice of this method as hereinafter described in detail the time required for the foregoing window formation can be cut at least in half and a significant cost reduction achieved in addition to the time savings realized. Further, in accordance with this invention, the number of trips into and out of the wellbore when forming a window can, as will be discussed hereinafter, be substantially reduced to achieve even more time and cost savings.

Yet additional savings can be realized by the practice of the method of this invention when it is employed through tubing already existing inside casing in a wellbore because this invention can be practiced through tubing without the necessity of removing that tubing from the wellbore before a window is formed in the casing. It should be understood, however, that this invention is not limited to through-tubing applications, but can be employed to form a window in production tubing itself or in wells where tubing is not present inside the casing.

As can be further seen from FIGS. 2 and 3, substantial milling with widely varying configurations of mills is required in addition to a trip out of the wellbore to remove starting mill 4 and a trip back into the hole with the window mill 18 and watermelon mill 20 or other suitable combination.

By the practice of the method of this invention the longest window available from a given whipstock is achieved with minimum milling time by employing a combination of coiled tubing, downhole motor, and window mill 18 instead of starting mill 5 when the angular relationship between the downhole motor-mill combination and the guide surface 13 of whipstock 10 is achieved as required by this invention and disclosed in greater detail hereinafter.

Further, not only does the method of this invention obtain the longest window available with substantially less milling time than required by prior art FIGS. 1 through 3, but this can be achieved, if desired, by eliminating one or more of the trips in and out of the wellbore as required by the procedure just described for FIGS. 1 through 3.

Figures 4A, 4B:
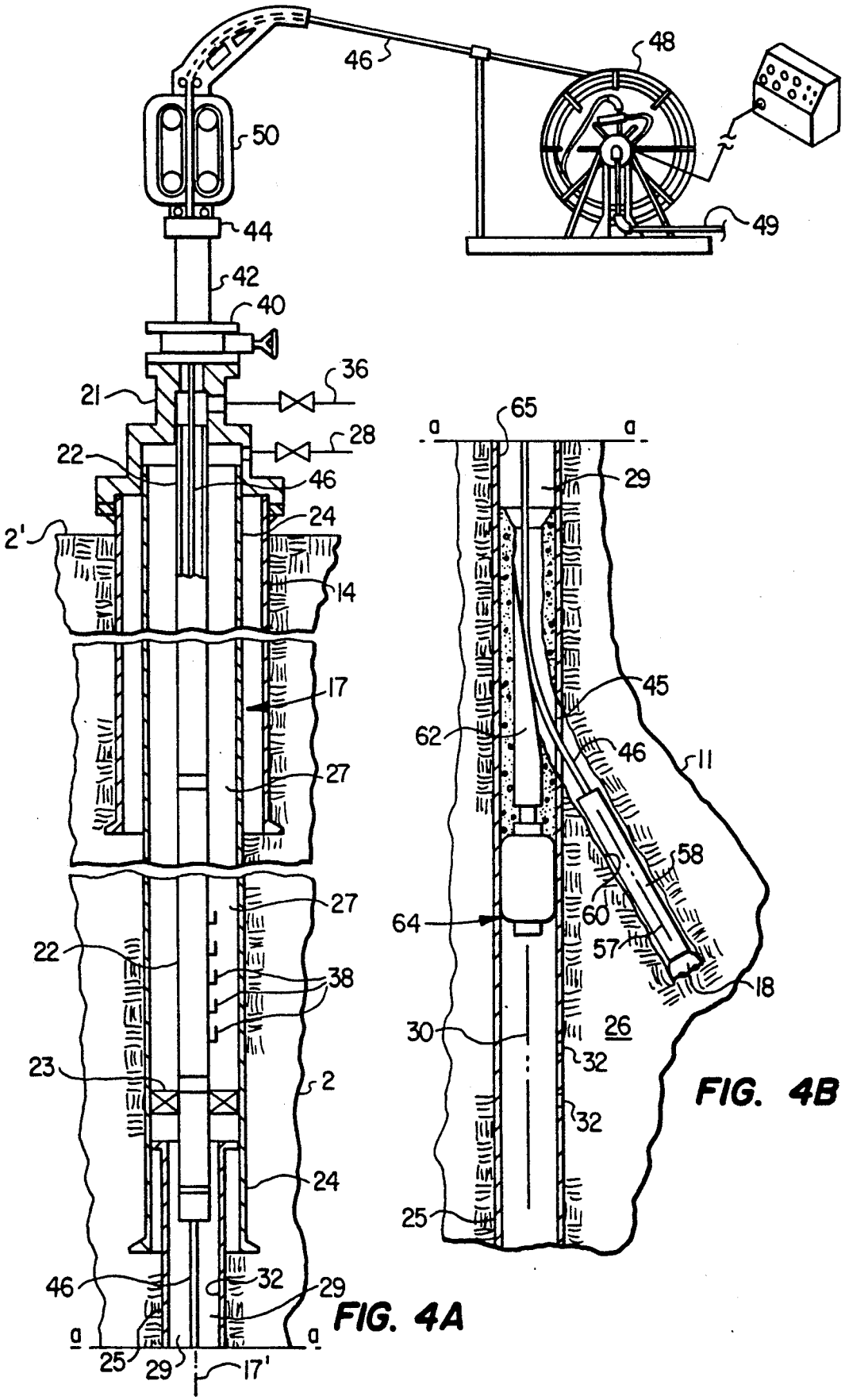
FIGS. 4A and 4B show one embodiment of coiled tubing apparatus employed in accordance with the method of this invention.

Referring now to FIGS. 4A and 4B, there is shown a cross section of an oil and gas production well, generally designated 17, whose longitudinal axis 17' extends downwardly into earth 2 from the surface 2' thereof. Well 17 includes a conventional surface casing 14, an intermediate casing string 24, and a production liner or casing 25 extending into a subsurface oil and gas producing zone 26. A conventional wellhead 21 is connected to casing strings 14 and 24 and is also suitably connected to production tubing string 22 extending within casing 24 and partially within casing 25. A suitable seal 24 is formed in the wellbore between tubing 22 and casing 24 by packer 23 or the like, thereby defining an annulus 27 between casing 24 and tubing 22. The well is adapted to produce fluids from zone 26 through suitable perforations 32 formed in production casing 25 at desired intervals. Produced fluids flow through production tubing 22 to production flow line 36 for storage, treatment, transporting, or the like. The well structure as described to this point is conventional and well known to those skilled in the art.

However, wellhead 20 is not superimposed at earth's surface 2' by a conventional rotary drilling rig. Instead, wellhead 20 is provided with a conventional crown valve 40 and a lubricator 42 mounted on crown valve 40. Lubricator 42 includes a stuffing box 44 through which may be inserted or withdrawn a coilable metal tubing string 46 (coiled tubing) which, in FIGS. 4A and 4B, is shown extending through tubing string 22 into casing 25 and diverted through a window 45 in casing 25 (FIG. 4B) as will be explained in further detail hereinafter. Tubing string 46 is adapted to be inserted into and withdrawn from the interior space of tubing 22 by way of a tubing injection unit 50 which is well known in the art. Tubing string 46 is normally coiled onto a storage reel 48 of the type described in further detail in U.S. Pat. No. 4,685,516 to Smith et al. Lubricator 42 is conventional in configuration and permits the connection of certain tools to the downhole end of tubing string 46 for insertion into and withdrawal from wellbore space 29 by way of coiled tubing 46.

If desired, produced fluid flowing into the interior of production tubing 22 can be artificially lifted to flow line 36 by injecting gas by way of flow line 28 into annulus 27 which then flows into the interior of tubing 22 by way of gas lift valves 38.

Window 45 in casing 25 of FIG. 4B is formed by operation of a combination of downhole motor 58 and window mill 18 as will be described in greater detail hereinafter, motor-mill combination 58-18 being carried by coiled tubing 46. Both motor 58 and window mill 18 are of conventional construction commercially available to those skilled in the art. The motor-mill combination 58-18 is of a diameter small enough to be passed through the interior of tubing 22 so that the longitudinal axis 57 of the motor-mill combination essentially coincides with the longitudinal axis 17' of the well and well conduits 14, 22, 24, and 25, i.e., essentially the same longitudinal axis for all of the tubing and casing strings including casing string 25 in which window 45 has been formed.

Motor 58 is driven by pressure fluid from the earth's surface 2' to rotate mill 18 to form window 45. Such pressure fluid, e.g., water, water with polymer additives, brine, or diesel fuel including additives, or other fluid including nitrogen or air, is supplied from a source (not shown) by way of conduit 49 and reel 48 to be pumped down through the interior of coiled tubing 46 and thereby operate motor 58. Such pressure fluid also serves as a cuttings evacuation fluid while forming window 45. As shown in FIG. 4B, coiled tubing string 46 has been diverted into the direction illustrated by whipstock 62 which is positioned in the interior space 29 of casing 25.

Referring to FIG. 4B, as well as FIGS. 5 through 8, whipstock 62 is set in place to provide for formation of window 45. Whipstock 62 is carefully oriented when set onto packer 64 so as to give the desired direction to side bore 60. A conventional inflatable packer 64 is conveyed into the interior space 29 of the wellbore and set in the position shown within casing 25 by passing the packer through the interior of tubing string 22 on the downhole end of coiled tubing 46. Packer 64 can also be of any conventional configuration, including setting mechanism, similar to that described in U.S. Pat. No. 4,787,446 to Howell et al. Coiled tubing string 46 is released from packer 64 once it is set in the position shown by utilizing any desirable and well known coupling system such as that described in U.S. Pat. No. 4,913,229 to D. Hearn.

Whipstock 62 includes an elongated guide surface 68 formed thereon. Guide surface 68, according to this invention, carries no wear projection such as projection 11 of FIGS. 1 and 2. Guide surface 68 slopes across the interior of casing 25 at an angle to longitudinal axis 30 of casing 25 and, therefore, at the same angle in relation to inner wall 65 of casing 25. Longitudinal axis 30 essentially coincides (essentially coaxial) with longitudinal axis 17' of wellbore 17.

Whipstock 62 includes a shank portion 70 which is insertable within a mandrel 72. Mandrel 72 is part of packer 64. Orientation of whipstock 62 is carried out utilizing conventional methods. For example, mandrel 72 may be provided with a suitable key way 77, FIG. 8, formed therein. Upon setting packer 64 in casing 25 a survey instrument is lowered into the wellbore to determine the orientation of key way 77 with respect to reference point and longitudinal axis 79. Whipstock shank 70 is then formed to have a key portion 80, FIG. 8, positioned with respect to guide surface 68 such that upon insertion of whipstock 62 into mandrel 72 key 80 would orient surface 68 in the preferred direction with respect to longitudinal axes 17 and 30. Upon setting whipstock 62 in the position shown in FIG. 5, a quantity of cement 82 is injected into casing 25 by conventional methods, including pumping the cement through coiled tubing 46, to encase whipstock 62 as shown. Once cement 82 is set, a pilot bore 84 is formed in cement 82 as indicated in FIG. 6, said bore including a funnel-shaped entry portion 86. Bore 84 and funnel-shaped entry portion 86 can be formed using a cutting tool 88 having a pilot bit portion 90 and retractable cutting blade 92 formed thereon. Cutting tool 88 may be of any conventional type such as that disclosed in U.S. Pat. No. 4,809,793 to C. D. Hailey, which describes a tool that can be conveyed on the end of a coiled tubing string such as string 46, and rotatably driven by a downhole motor similar to motor 58 to form pilot bore 84 and entry portion 86. Pilot bore portion 84 is preferably formed substantially coaxial with longitudinal axis 30 of casing 25 and 17' of the wellbore.

Upon formation of pilot bore 84, tool 88 is withdrawn from the wellbore through tubing string 22 and replaced by the aforesaid combination of downhole motor 58 and mill 18. Mill 18 is directly connected to motor 58 so that operation of motor 58 by way of fluid being pumped through the interior of coiled tubing 46 rotates mill 18. Motor-mill combination 58-18 is lowered on tubing 46 into the wellbore through tubing string 22 so that the longitudinal axis 57 of this tool combination essentially coincides with longitudinal axes 17' and 30 while passing downwardly through tubing 22 and casing 25 until it reaches pilot bore 84. At least by that time, pressure fluid is supplied through the interior of coiled tubing 46 to operate motor 58 thereby rotating window mill 18 to begin milling out a portion of cement plug 82 and the wall of casing 25 to form window 45 as shown in FIG. 7.

The milling operation is continued until mill 18 has formed window 45 whereupon coiled tubing string 46 is withdrawn through tubing string 22 until motor 58 and mill 18 are in lubricator 42. Window mill 18 can then be removed and replaced by a dressing mill such as watermelon mill 20, if desired, for smoothing or otherwise dressing the edges of window 45 by operation of the larger dressing mill 20. Alternatively, the watermelon mill and speed mill can be run in combination. Dressing mill 20 is lowered to window 45 at the end of coiled tubing 46 in the same manner as shown in FIG. 3 for straight tubing 3. Dressing mill 20 is then rotated by way of motor 58 as described hereinabove with respect to mill 18 through window 45 to dress up the edges of window 45 for ease of passage of tools through that window during subsequent well operation using coiled tubing 46 after motor 58 and dressing mill 20 have been removed.

An important aspect in the overall combination of this invention is the angular relation in which the motor-mill combination 58-18 engages guide surface 68 of whipstock 62. This aspect of the invention is shown in detail in FIG. 9, wherein it is shown that when motor-mill combination 58-18 engages guide surface 68 the longitudinal axis 57 of such tool combination is at an angle C with relation to the longitudinal axis 30 of casing 25. Accordingly, the motor-mill combination is at an angle such that mill 18 will engage inner wall 65 of casing 25. However, mill 18 cannot engage wall 65 at just any angle. If the angle of the longitudinal axis 57 of the motor-mill combination 58-18 is not in accordance with this invention, mill 18 will bite into whipstock 62 to a considerable extent, if not preferentially, thereby considerably slowing the rate at which the desired window is formed and losing the cost and time advantage incurred by employing a coiled tubing unit in the first place. Thus, it can be seen that, if motor-mill combination 58-18 is not engaged in the manner required by this invention as set forth hereinafter, the advantages of employing a coiled tubing unit can be substantially lost. Further, substantial wear and tear can be incurred for window mill 18 thereby needlessly shortening its work life if the engagement of the motor-mill combination 58-18 with guide surface 68 of whipstock 62 is not followed in accordance with this invention.

In accordance with this invention, longitudinal axis 57 motor-mill combination 58-18 is adjusted so that when combination 58-18 engages surface guide 68 of whipstock 62 angle A (which is the angle of longitudinal axis 57 in relation to inner wall 65) is greater than angle B (which is the angle of longitudinal axis 57 in relation to guide surface 68). If angle A is greater than angle B, essentially no greater than normal wear and tear will be experienced by guide surface 68 when forming window 45 in accordance with the method of this invention. When angle A is less than angle B, substantial milling of the body of whipstock 62 will be incurred by mill 18 thereby considerably slowing the window formation time as well as raising the cost of the operation and inducing unnecessary wear and tear on mill 18 and motor 58. Angle A need not be substantially greater than angle B, but must be greater to some finite extent, it being preferable that angle B come as close as possible to zero degrees.

With the teaching of this invention numerous ways of engaging mill 18 with surface guide 68 to meet the angular requirements of this invention will be obvious to those skilled in the art. For example, the required angular relationship for angles A and B of this invention can be achieved by employing a bent motor, tool, or sub; or a motor-mill combination 58-18 which is the shortest practicable while at the same time employing a whipstock guide surface 68 which is as long as practicable. Generally, angle B can be kept smaller than angle A by employing a motor-mill combination 58-18 which is shorter than the length of guide surface 68, preferably, at least about 15 percent shorter than guide surface 68. Other ways and means to accomplish this angular relationship will be obvious to those skills in the art and need not be disclosed here, but are intended to be included within the scope of this invention.

It should be noted here that pursuant to this invention guide surface 68 carries no wear projection, pad, or lug such as that shown by reference numeral 11 in FIG. 1. However, even without such a protective mechanism as projection 11 window 45 can be milled efficiently without undue or exorbitant cutting of the body of whipstock 62 by mill 18. Accordingly, it is readily seen that the function of wear projection 11 of FIG. 1 is eliminated by this invention without eliminating the beneficial results obtained projection 11, i.e., nonmilling to any substantial degree of whipstock 62 while forming window 45 in casing 25.

If angle A is kept larger than angle B when mill 18 engages guide surface 68, the milling operation can be carried out at high mill rotation speed without substantial weight being imposed on motor-mill combination 58-18 by way of coiled tubing 46. Accordingly, relative low weight can be imposed on motor-mill combination 58-18, but a high cutting rate of window 45 achieved by rotating mill 18 at a rate of at least about 150 rpm, preferably at least about 200 rpm. This further minimizes the risk of cutting into whipstock 62 while at the same time maximizing the amount and speed of cutting of casing 25 even though massive application of weight through tubing 46 is eliminated.

Figure 9:
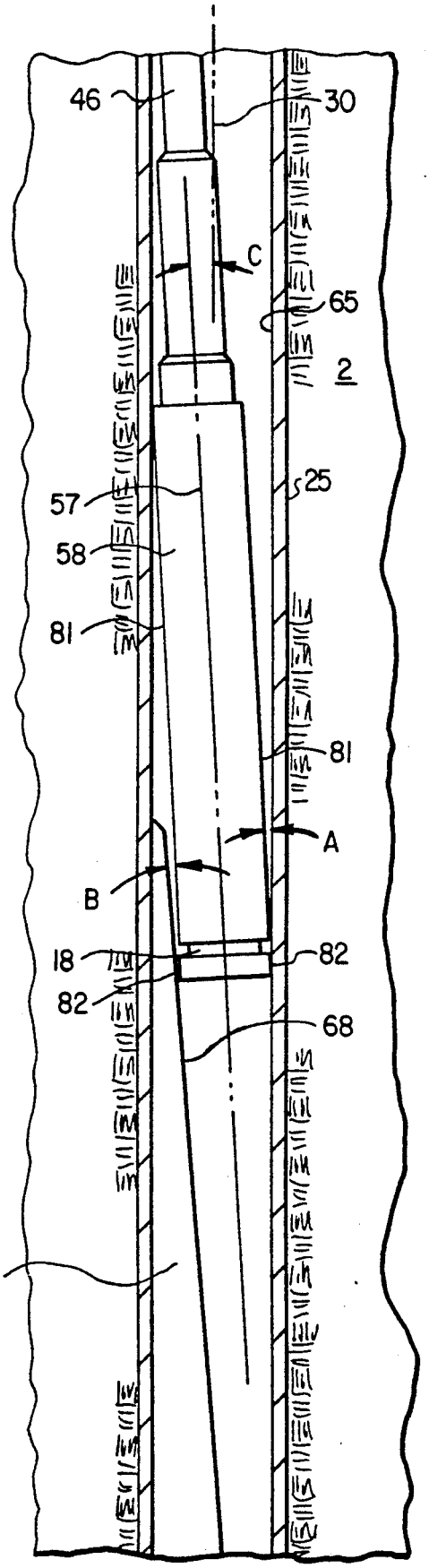
FIG. 9 shows in detail the manner in which the downhole motor-mill combination is employed in relation to the conventional whipstock in order to achieve the advantages of this invention.

It can be seen from FIG. 9 that longitudinal axis 57 is, because of the right cylindrical configuration of downhole motor 58, parallel to the outer surface 81 of motor 58. Similarly, the outer surface or gauge 82 of mill 18 is parallel to axis 57. Thus, angle A can be measured between outer surface 81 and inner wall 65 and angle B can be measured between outer surface 81 and guide surface 68, both as shown in FIG. 9, and the angular requirements of this invention still met. Accordingly, angles A and B can be measured and controlled in various ways in order to meet the requirement of this invention that motor-mill combination 58-18 engage guide surface 68 along guide surface 68 in a manner such that angle A of longitudinal axis 57 of combination 58-18 in relation to the inner wall 65 of casing 25 is greater than angle B of the same longitudinal axis 57 in relation to guide surface 68.

As can be seen from above, this invention in its broadest form employs a coiled tubing technique in combination with a conventional downhole motor, a window mill in lieu of the conventional starting mill, and a special angular relationship of the downhole motor-mill combination in relation to the inner wall of the well conduit in which a window is to be formed and the guide surface of the whipstock.

By employing this combination in the method of this invention a suitable window can be formed without additional steps or practices. However, still within the scope of this invention, a watermelon mill or other type of dressing mill can be employed as a subsequent step as shown in FIG. 3 except that tubing 3 is replaced with tubing 46.

When compared to conventional window formation procedures using a rotary drilling rig and up to three or more trips into and out of the wellbore, the first to set the whipstock, the second to mill the window with starting mill 4 as shown in FIG. 2, and the third to enlarge the window with a dressing mill 20 as shown in FIG. 3, by the practice of the method of this invention, two trips can be employed, the first to set the whipstock and the second to mill the window with window mill 18. However, it is within the scope of this invention to practice the third trip by going back in the hole and dressing the window with a watermelon mill, if desired. Also by the method of this invention, the prior art third trip can be eliminated by combining the window mill 18 and the dressing mill 20 in the same tool string (as shown in FIG. 3) and employing the combination below motor 58 so that milling the window and dressing the window can both be accomplished in the same trip. Finally, the procedure can be reduced to one trip and still be within the scope of this invention if the whipstock is carried below the window mill initially by means of a shear pin which does not serve as a wear projection after it is sheared. This way, in one trip the whipstock can be set, the shear pin sheared and the motor-mill combination employed to cut and even dress the window in the manner required by this invention.

All of the aforesaid alternative procedures within this invention save considerable time and expense over the conventional three step window formation process of the prior art as represented by FIGS. 1 through 3.

EXAMPLE

A window formation procedure was carried out in an existing oil and gas well which was lined with casing 25 but contained no production tubing 22. Apparatus substantially the same as that shown in FIGS. 4A and 4B was employed using the process of this invention as described hereinabove with respect to FIGS. 4A through 8. A conventional diamond speed mill was employed for window mill 18 in the initial formation of window 45 using a downhole moyno-type motor to rotate the speed mill at approximately 200 rpm. The downhole motor-speed mill combination had a total length of approximately eleven feet. A twenty foot whipstock guide surface 68 was employed. The motor-mill combination had an outside diameter of 3 ¾ inches. Casing 25 has an inside diameter of 4.95 inches. When the motor-mill combination first engaged the whipstock guide surface 68, angle A was less than one degree greater than angle B. Window 45 was milled in casing 25 without substantial milling into whipstock 62.

Reasonable variations and modifications are possible within the scope of this disclosure without departing from the spirit and scope of this invention.

What is claimed is:

1. A method for forming a window in a subsurface well conduit, said conduit having an inner wall that defines the interior space of said conduit, said conduit having a longitudinal axis which is essentially parallel to said inner wall, the method comprising providing a coiled tubing injection unit carrying coiled tubing for insertion into said interior space of said conduit along at least part of the length of said conduit, providing a downhole motor-window mill combination at one end of said coiled tubing, said motor-mill combination having a longitudinal axis which when inserted into said interior space of said conduit is essentially coaxial with the longitudinal axis of said conduit, setting whipstock means having an elongate guide surface in said interior space of said conduit at a position along the length of said conduit where said window is to be formed, said guide surface having no wear projection thereon for guiding a mill, said guide surface sloping across said interior space of said conduit at an angle to said longitudinal axis of said conduit, inserting said motor-mill combination into said conduit, moving said motor-mill combination down to said whipstock means, engaging said motor-mill combination with said whipstock along said guide surface in a manner such that the angle of said longitudinal axis of said motor-mill combination in relation to said inner wall of said conduit is greater than the angle of said longitudinal axis of said motor-mill combination in relation to said guide surface, and moving said motor-mill combination along said guide surface with said coiled tubing while operating said mill by way of said downhole motor to remove a portion of said conduit and form a window in same.

2. The method according to claim 1 wherein said motor-mill combination is removed from said well conduit, said mill is replaced with a dressing mill, and said motor-dressing mill is inserted into said well conduit and said dressing mill rotated through said window to dress up the edges thereof for ease of passage of tools through said window.

3. The method according to claim 1 wherein said mill is rotated at least about 150 rpm when milling said window.

4. The method according to claim 1 wherein said motor-mill combination is passed through at least a portion of production tubing carried in the interior of said well conduit before said window is milled in said well conduit.

5. The method according to claim 1 wherein said well conduit has no production tubing in the interior thereof.

6. The method according to claim 1 wherein said motor-mill combination is as short as practicable and said whipstock guide surface is as long as practicable.

7. The method according to claim 1 wherein said motor-mill combination is shorter than said whipstock guide surface.

8. The method according to claim 1 wherein said motor-mill combination is at least about 15% shorter than said whipstock guide surface.

9. The method according to claim 1 wherein said motor-mill combination contains in addition a dressing mill to thereby eliminate a trip out of said well conduit to replace said mill with said dressing mill.

10. The method according to claim 1 wherein the angle of the longitudinal axis of said motor-mill combination in relation to said guide surface is essentially zero.

* * * * *